US010864409B2

(12) United States Patent
Sajima et al.

(10) Patent No.: US 10,864,409 B2
(45) **Date of Patent: *Dec. 15, 2020**

(54) GOLF BALL

(71) Applicant: SUMITOMO RUBBER INDUSTRIES, LTD., Kobe (JP)

(72) Inventors: Takahiro Sajima, Kobe (JP); Hironori Takihara, Kobe (JP); Toshiyuki Takubo, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/272,543

(22) Filed: Feb. 11, 2019

(65) Prior Publication Data

US 2019/0269979 A1 Sep. 5, 2019

(30) Foreign Application Priority Data

Mar. 1, 2018 (JP) ..... 2018-036557
Dec. 7, 2018 (JP) ..... 2018-229693

(51) Int. Cl.
*A63B 37/06* (2006.01)
*A63B 37/00* (2006.01)

(52) U.S. Cl.
CPC ..... *A63B 37/0012* (2013.01); *A63B 37/0005* (2013.01); *A63B 37/0015* (2013.01); *A63B 37/0019* (2013.01); *A63B 37/0021* (2013.01); *A63B 37/0022* (2013.01); *A63B 37/0033* (2013.01); *A63B 37/0075* (2013.01)

(58) Field of Classification Search
CPC ..... A63B 37/0005; A63B 37/0004
USPC ..... 473/378
See application file for complete search history.

(56) References Cited

U.S. PATENT DOCUMENTS

| | | | | |
|---|---|---|---|---|
| 2011/0077106 | A1 | 3/2011 | Fitchett | |
| 2015/0182805 | A1 | 7/2015 | Sajima et al. | |
| 2016/0166888 | A1* | 6/2016 | Kim | A63B 37/003 473/377 |
| 2018/0056136 | A1* | 3/2018 | Mimura | A63B 37/0005 |
| 2018/0056138 | A1* | 3/2018 | Sajima | A63B 37/0075 |
| 2019/0269975 | A1* | 9/2019 | Sajima | A63B 37/0005 |

FOREIGN PATENT DOCUMENTS

| | | | |
|---|---|---|---|
| JP | 02-068077 | A | 3/1990 |
| JP | 2011-072776 | A | 4/2011 |
| JP | 2015-142599 | A | 8/2015 |

* cited by examiner

*Primary Examiner* — Raeann Gorden
(74) *Attorney, Agent, or Firm* — Birch, Stewart, Kolasch & Birch, LLP

(57) ABSTRACT

A golf ball has a plurality of dimples 12 and a land 14 on a surface thereof. The golf ball further has a large number of minute projections 18 formed on surfaces of the dimples 12 and the land 14. The surface of the golf ball has an arithmetic average height Sa of not less than 0.5 μm and not greater than 30 μm. An average value Hav of heights H of the minute projections 18 is not less than 0.5 μm and not greater than 50 μm. A ratio Pp of a sum of areas of all the minute projections 18 to a surface area of a phantom sphere of the golf ball is not less than 7%. An average value Dav of diameters D of the minute projections 18 is not less than 5 μm and not greater than 50 μm.

9 Claims, 7 Drawing Sheets

GOLF BALL

This application claims priority on Patent Application No. 2018-036557 filed in Japan on Mar. 1, 2018 and Patent Application No. 2018-229693 filed in Japan on Dec. 7, 2018. The entire contents of these Japanese Patent Applications are hereby incorporated by reference.

BACKGROUND OF THE INVENTION

Field of the Invention

The present invention relates to golf balls. Specifically, the present invention relates to golf balls each having a paint layer on the surface thereof.

Description of the Related Art

Golf balls have a large number of dimples on the surfaces thereof. The dimples disturb the air flow around the golf ball during flight to cause turbulent flow separation. This phenomenon is referred to as "turbulization". Due to turbulization, separation points of the air from the golf ball shift backwards leading to a reduction of drag. The turbulization promotes the displacement between the separation point on the upper side and the separation point on the lower side of the golf ball, which results from the backspin, thereby enhancing the lift force that acts upon the golf ball. The reduction of drag and the enhancement of lift force are referred to as a "dimple effect". Excellent dimples efficiently disturb the air flow. Excellent dimples produce a long flight distance.

A flight distance of a golf ball is the total of a carry and a run. The carry is the distance from the launch point to the landing point. The run is the distance from the landing point to the stopping point. Upon a shot with a short iron, a large carry and a small run are desired. This is because golf players place importance on causing a golf ball to stop at a target point upon a shot with a short iron. Meanwhile, upon a shot with a driver, a large carry and a large run are desired. This is because golf players desire to make a golf ball as close to the pin as possible upon a shot with a driver. Regarding second shots and the like in par-five holes, a large carry and a large run may be desired even upon shots with a long iron and a middle iron.

The depths of dimples influence the aerodynamic characteristics of a golf ball. Deep dimples reduce the lift force that acts upon a golf ball. A trajectory of a golf ball having deep dimples is low. Therefore, with this golf ball, a large run is obtained. However, a carry of this golf ball is not sufficient. There is room for improvement in the flight distance (total) of this golf ball.

JP2015-142599 discloses a golf ball having a surface with large roughness. The roughness can be formed by blasting or the like. The roughness enhances the aerodynamic characteristics of the golf ball due to a synergetic effect with dimples.

JP2011-72776 discloses a golf ball having a coating formed from a paint that contains particles. The particles enhance the aerodynamic characteristics of the golf ball due to a synergetic effect with dimples.

JPH2-68077 discloses a golf ball having dimples each having one projection at a bottom thereof. The dimples each having the projection enhance the aerodynamic characteristics of the golf ball.

A golf ball has a paint layer. The roles of the paint layer are to enhance the appearance and to protect a main body.

The greatest interest to golf players concerning golf balls is flight distance. Golf players desire golf balls having excellent flight performance. Golf players desire large flight distances (total) upon shots with a driver, a long iron, and a middle iron. For flight distances upon shots with middle irons, conventional studies are insufficient.

When a golf ball is hit with a golf club, the golf ball collides against the clubface of the golf club. When a golf ball falls, the golf ball collides against the ground. Due to these collisions, the paint may be peeled from the main body. This peeling impairs the appearance of the golf ball.

An object of the present invention is to provide a golf ball having excellent flight performance upon a shot with a middle iron. Another object of the present invention is to provide a golf ball having a paint layer that is less likely to be peeled.

SUMMARY OF THE INVENTION

A golf ball according to the present invention has a main body and a paint layer positioned outside the main body. The golf ball has, on a surface thereof, a plurality of minute projections each having a shape in which a surface shape of the main body is reflected. The surface of the golf ball has an arithmetic average height Sa of not less than 0.5 μm and not greater than 30 μm. An average value Hav of heights H of the minute projections is not less than 0.5 μm and not greater than 50 μm.

With the golf ball according to the present invention, the minute projections reduce lift force of the golf ball during flight. A trajectory of the golf ball is not excessively high. Therefore, with the golf ball, a large flight distance is obtained upon a shot with a middle iron.

The golf ball has a plurality of minute projections each having a shape in which the surface shape of the main body is reflected. In other words, the main body has projection portions that cause the minute projections. Therefore, the main body and the paint layer are in contact with each other with a large area. The projection portions further serve as anchors to the paint layer. The paint layer is less likely to be peeled from the main body.

Preferably, a ratio Pp of a sum of areas of all the minute projections to a surface area of a phantom sphere of the golf ball is not less than 7%.

Preferably, an average value Dav of diameters D of the minute projections is not less than 5 μm and not greater than 50 μm.

Preferably, an average value Pav of pitches P each between a minute projection and another minute projection adjacent to this minute projection is not greater than 100 μm.

Preferably, the surface of the golf ball has a maximum height Sz of not less than 5 μm and not greater than 200 μm.

The golf ball may further have a plurality of dimples on the surface thereof. Preferably, the average value Hav of the heights H of the minute projections and an average value Dpav of depths Dp of the dimples satisfy the following mathematical formula (1).

$$Hav/Dpav \leq 0.005 \quad (1)$$

Preferably, the paint layer has a thickness of not less than 5 μm and not greater than 30 μm. Preferably, the paint layer contains powder having an average particle diameter of not less than 1 μm and not greater than 15 μm.

DESCRIPTION OF THE PREFERRED EMBODIMENTS

The following will describe in detail the present invention based on preferred embodiments with appropriate reference to the drawings.

Figure 1:
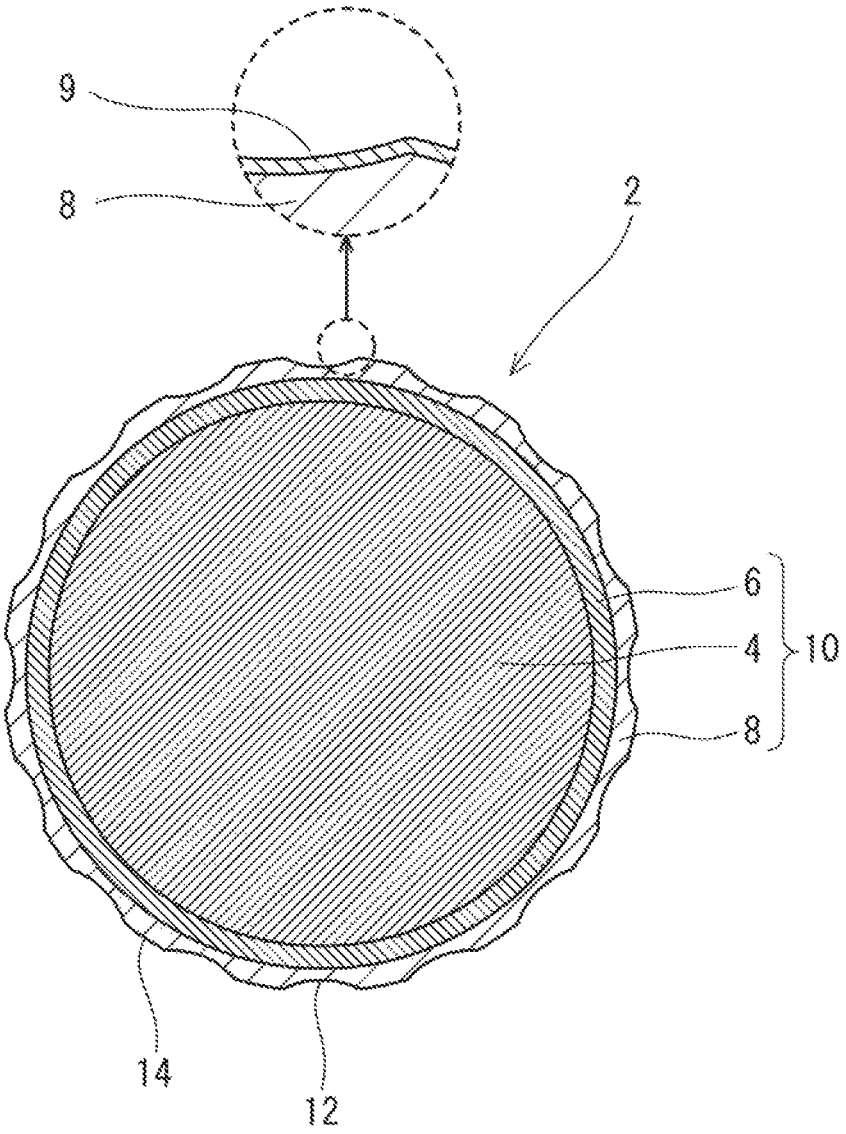
FIG. 1 is a cross-sectional view of a golf ball according to an embodiment of the present invention.

A golf ball 2 shown in FIG. 1 includes a spherical core 4, a mid layer 6 positioned outside the core 4, a cover 8 positioned outside the mid layer 6, and a paint layer 9 positioned outside this cover. The core 4, the mid layer 6, and the cover 8 are included in a main body 10 of the golf ball 2. The golf ball 2 has a large number of dimples 12 on the surface thereof. Of the surface of the golf ball 2, a part other than the dimples 12 is a land 14. The main body 10 may have a one-piece structure, a two-piece structure, a four-piece structure, a five-piece structure, or the like.

The golf ball 2 preferably has a diameter of not less than 40 mm and not greater than 45 mm. From the viewpoint of conformity to the rules established by the United States Golf Association (USGA), the diameter is particularly preferably not less than 42.67 mm. In light of suppression of air resistance, the diameter is more preferably not greater than 44 mm and particularly preferably not greater than 42.80 mm. The diameter of the golf ball 2 according to the present embodiment is 42.7 mm.

The golf ball 2 preferably has a weight of not less than 40 g and not greater than 50 g. In light of attainment of great inertia, the weight is more preferably not less than 44 g and particularly preferably not less than 45.00 g. From the viewpoint of conformity to the rules established by the USGA, the weight is particularly preferably not greater than 45.93 g.

Preferably, the core 4 is formed by crosslinking a rubber composition. Examples of the base rubber of the rubber composition include polybutadienes, polyisoprenes, styrene-butadiene copolymers, ethylene-propylene-diene copolymers, and natural rubbers. Two or more rubbers may be used in combination. In light of resilience performance, polybutadienes are preferable, and high-cis polybutadienes are particularly preferable.

The core 4 may be formed from a resin composition. The core 4 may be formed from a mixture of a rubber composition and a resin composition. A resin composition that will be described later for the mid layer 6 or the cover 8 can be used for the core 4.

The rubber composition of the core 4 includes a co-crosslinking agent. Examples of preferable co-crosslinking agents in light of resilience performance include zinc acrylate, magnesium acrylate, zinc methacrylate, and magnesium methacrylate. The rubber composition preferably includes an organic peroxide together with a co-crosslinking agent. Examples of preferable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide.

The rubber composition of the core 4 may include additives such as a filler, sulfur, a vulcanization accelerator, a sulfur compound, an anti-aging agent, a coloring agent, a plasticizer, and a dispersant. The rubber composition may include a carboxylic acid or a carboxylate. The rubber composition may include synthetic resin powder or cross-linked rubber powder.

The core 4 has a diameter of preferably not less than 30.0 mm and particularly preferably not less than 38.0 mm. The diameter of the core 4 is preferably not greater than 42.0 mm and particularly preferably not greater than 41.5 mm. The core 4 may have two or more layers. The core 4 may have a rib on the surface thereof. The core 4 may be hollow.

The mid layer 6 is formed from a resin composition. A preferable base polymer of the resin composition is an ionomer resin. Examples of preferable ionomer resins include binary copolymers formed with an α-olefin and an α,β-unsaturated carboxylic acid having 3 to 8 carbon atoms. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. For the binary copolymer and the ternary copolymer, preferable α-olefins are ethylene and propylene, while preferable α,β-unsaturated carboxylic acids are acrylic acid and methacrylic acid. In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion.

Instead of an ionomer resin or together with an ionomer resin, the resin composition of the mid layer 6 may include another polymer. Examples of the other polymer include polystyrenes, polyamides, polyesters, polyolefins, and polyurethanes. The resin composition may include two or more polymers.

The resin composition of the mid layer 6 may include a coloring agent such as titanium dioxide, a filler such as barium sulfate, a dispersant, an antioxidant, an ultraviolet absorber, a light stabilizer, a fluorescent material, a fluorescent brightener, and the like. For the purpose of adjusting specific gravity, the resin composition may include powder of a metal with a high specific gravity such as tungsten, molybdenum, and the like.

The mid layer 6 has a thickness of preferably not less than 0.2 mm and particularly preferably not less than 0.3 mm. The thickness of the mid layer 6 is preferably not greater than 2.5 mm and particularly preferably not greater than 2.2 mm. The mid layer 6 has a specific gravity of preferably not less than 0.90 and particularly preferably not less than 0.95. The specific gravity of the mid layer 6 is preferably not greater than 1.10 and particularly preferably not greater than 1.05. The mid layer 6 may have two or more layers.

The cover 8 is formed from a thermoplastic resin composition, a thermosetting resin composition, or a mixture of both compositions. Preferably, the cover 8 is formed from a thermoplastic resin composition. Examples of the base polymer of the resin composition include ionomer resins, thermoplastic polyester elastomers, thermoplastic polyamide elastomers, thermoplastic polyurethane elastomers, thermoplastic polyolefin elastomers, and thermoplastic polystyrene elastomers. Ionomer resins are particularly preferable. Ionomer resins are highly elastic. The golf ball 2 having the cover 8 that includes an ionomer resin has excellent resilience performance. The golf ball 2 has excellent flight distance upon a shot with a driver. The ionomer resin described above for the mid layer 6 can be used for the cover 8.

An ionomer resin and another resin may be used in combination. In this case, in light of resilience performance, the ionomer resin is included as the principal component of the base polymer. The proportion of the ionomer resin to the entire base polymer is preferably not less than 50% by weight, more preferably not less than 70% by weight, and particularly preferably not less than 80% by weight.

The resin composition of the cover 8 may include a pigment. The resin composition can include an inorganic pigment and an organic pigment. Examples of the inorganic pigment include: red pigments such as iron oxide red ($Fe_2O_3$), red lead ($Pb_3O_4$), molybdenum red, and cadmium red; yellow pigments such as titanium yellow ($TiO_2$—$NiO$—$Sb_2O_3$), litharge ($PbO$), chrome yellow ($PbCrO_4$), yellow iron oxide ($FeO(OH)$), and cadmium yellow; and blue pigments such as cobalt blue ($CoO.Al_2O_3$), Prussian blue, and ultramarine blue. Examples of the organic pigment include azo pigments, phthalocyanine pigments, and perylene pigments. Azo pigments are preferable. Examples of azo pigments include pigment yellow 1, pigment yellow 12, pigment red 3, pigment red 57, and pigment orange 13.

The resin composition of the cover 8 may include a filler, a dispersant, an antioxidant, an ultraviolet absorber, a light stabilizer, a fluorescent material, a fluorescent brightener, and the like in an adequate amount.

The cover 8 has a thickness of preferably not less than 0.2 mm and particularly preferably not less than 0.3 mm. The thickness of the cover 8 is preferably not greater than 2.5 mm and particularly preferably not greater than 2.2 mm. The cover 8 has a specific gravity of preferably not less than 0.90 and particularly preferably not less than 0.95. The specific gravity of the cover 8 is preferably not greater than 1.10 and particularly preferably not greater than 1.05. The cover 8 may have two or more layers.

Figure 2:
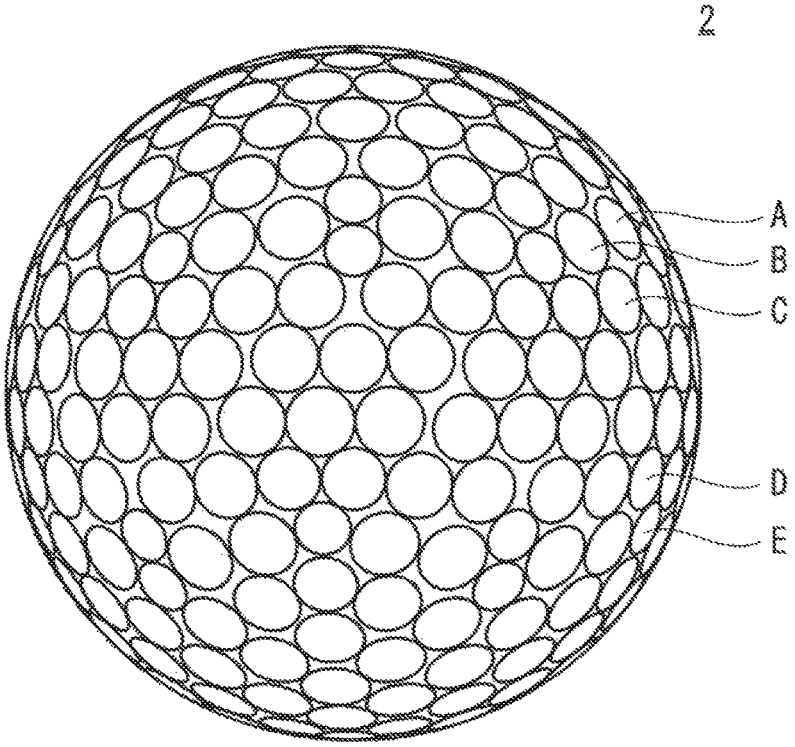
FIG. 2 is an enlarged front view of the golf ball in FIG. 1.
Figure 3:
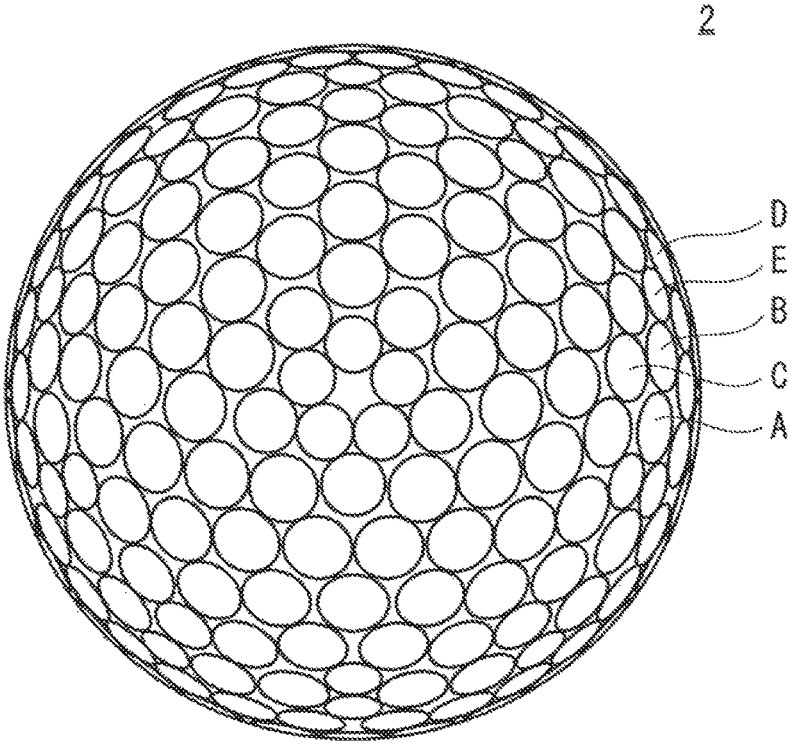
FIG. 3 is a plan view of the golf ball in FIG. 2.

FIG. 2 is an enlarged front view of the golf ball 2 in FIG. 1, and FIG. 3 is a plan view of the golf ball 2. As described above, the golf ball 2 has a large number of the dimples 12 on the surface thereof. The contour of each dimple 12 is circular. The golf ball 2 has dimples A each having a diameter of 4.40 mm; dimples B each having a diameter of 4.30 mm; dimples C each having a diameter of 4.20 mm; dimples D each having a diameter of 3.95 mm; and dimples E each having a diameter of 3.50 mm. The number of types of the dimples 12 is five. The golf ball 2 may have non-circular dimples instead of the circular dimples 12 or together with circular dimples 12.

The number of the dimples A is 30; the number of the dimples B is 140; the number of the dimples C is 90; the number of the dimples D is 40; and the number of the dimples E is 40. The total number of the dimples 12 is 340. A dimple pattern is formed by these dimples 12 and the land 14.

Figure 4:
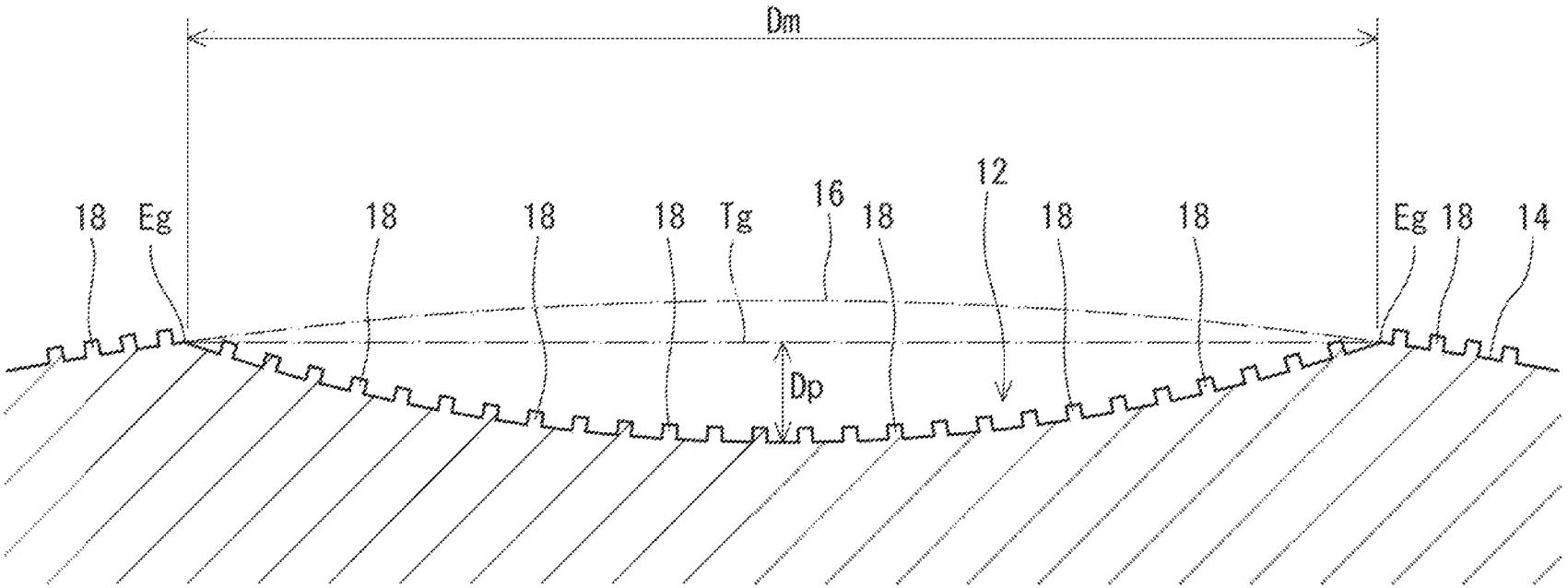
FIG. 4 is a partially enlarged cross-sectional view of the golf ball in FIG. 1.

FIG. 4 shows a cross section of the golf ball 2 along a plane passing through the central point of a dimple 12 and the central point of the golf ball 2. In FIG. 4, the top-to-bottom direction is the depth direction of the dimple 12. In FIG. 4, an alternate long and two short dashes line 16 indicates a phantom sphere. The surface of the phantom sphere 16 is the surface of the golf ball 2 when it is postulated that no dimple 12 and no minute projection 18 (described in detail later) exist. The diameter of the phantom sphere 16 is equal to the diameter of the golf ball 2. The dimple 12 is recessed from the surface of the phantom sphere 16. The land 14 coincides with the surface of the phantom sphere 16.

In FIG. 4, an arrow Dm indicates the diameter of the dimple 12. The diameter Dm is the distance between two tangent points Eg appearing on a tangent line Tg that is drawn tangent to the far opposite ends of the dimple 12. Each tangent point Eg is also the edge of the dimple 12. The edge Eg defines the contour of the dimple 12.

The diameter Dm of each dimple 12 is preferably not less than 2.0 mm and not greater than 6.0 mm. The dimple 12 having a diameter Dm of not less than 2.0 mm contributes to turbulization. From this viewpoint, the diameter Dm is more preferably not less than 2.5 mm and particularly preferably not less than 2.8 mm. The dimple 12 having a diameter Dm of not greater than 6.0 mm does not impair a fundamental feature of the golf ball 2 being substantially a sphere. From this viewpoint, the diameter Dm is more preferably not greater than 5.5 mm and particularly preferably not greater than 5.0 mm.

In the case of a non-circular dimple, a circular dimple 12 having the same area as that of the non-circular dimple is assumed. The diameter of the assumed dimple 12 can be regarded as the diameter of the non-circular dimple.

In FIG. 4, a double ended arrow Dp indicates the depth of the dimple 12. The depth Dp is the distance between the deepest part of the dimple 12 and the tangent line Tg. An average depth Dpav is calculated by summing the depths Dp of all the dimples 12 and dividing the sum of the depths Dp by the total number of the dimples 12. The average depth Dpav is preferably not less than 80 μm and not greater than 200 μm. With the golf ball 2 in which the average depth Dpav is not less than 80 μm, a large run can be achieved. From this viewpoint, the average depth Dpav is more preferably not less than 100 μm and particularly preferably not less than 110 μm. With the golf ball 2 in which the average depth Dpav is not greater than 200 μm, a large carry can be achieved. From this viewpoint, the average depth Dpav is more preferably not greater than 180 μm and particularly preferably not greater than 160 μm.

The area S of the dimple 12 is the area of a region surrounded by the contour line of the dimple 12 when the central point of the golf ball 2 is viewed at infinity. In the case of a circular dimple 12, the area S is calculated by the following mathematical formula.

$$S=(Dm/2)^2*\pi$$

In the golf ball 2 according to the present embodiment, the area of each dimple A is 15.20 $mm^2$; the area of each dimple B is 14.52 $mm^2$; the area of each dimple C is 13.85 $mm^2$; the area of each dimple D is 12.25 $mm^2$; and the area of each dimple E is 9.62 $mm^2$.

From the viewpoint of achieving a sufficient total area of the dimples 12, the total number N of the dimples 12 is preferably not less than 250, more preferably not less than 280, and particularly preferably not less than 300. From the viewpoint that each dimple 12 can contribute to turbulization, the total number N is preferably not greater than 500, more preferably not greater than 450, and particularly preferably not greater than 400.

In the present invention, the "volume of the dimple" means the volume of a portion surrounded by the surface of the dimple 12 and the plane including the contour of the dimple 12. From the viewpoint that a large run can be achieved, the total volume of the dimples 12 is preferably not less than 240 $mm^3$, more preferably not less than 260

$mm^3$, and particularly preferably not less than 270 $mm^3$. From the viewpoint that a large carry can be achieved, the total volume is preferably not greater than 400 $mm^3$, more preferably not greater than 360 $mm^3$, and particularly preferably not greater than 330 $mm^3$.

Figure 5:
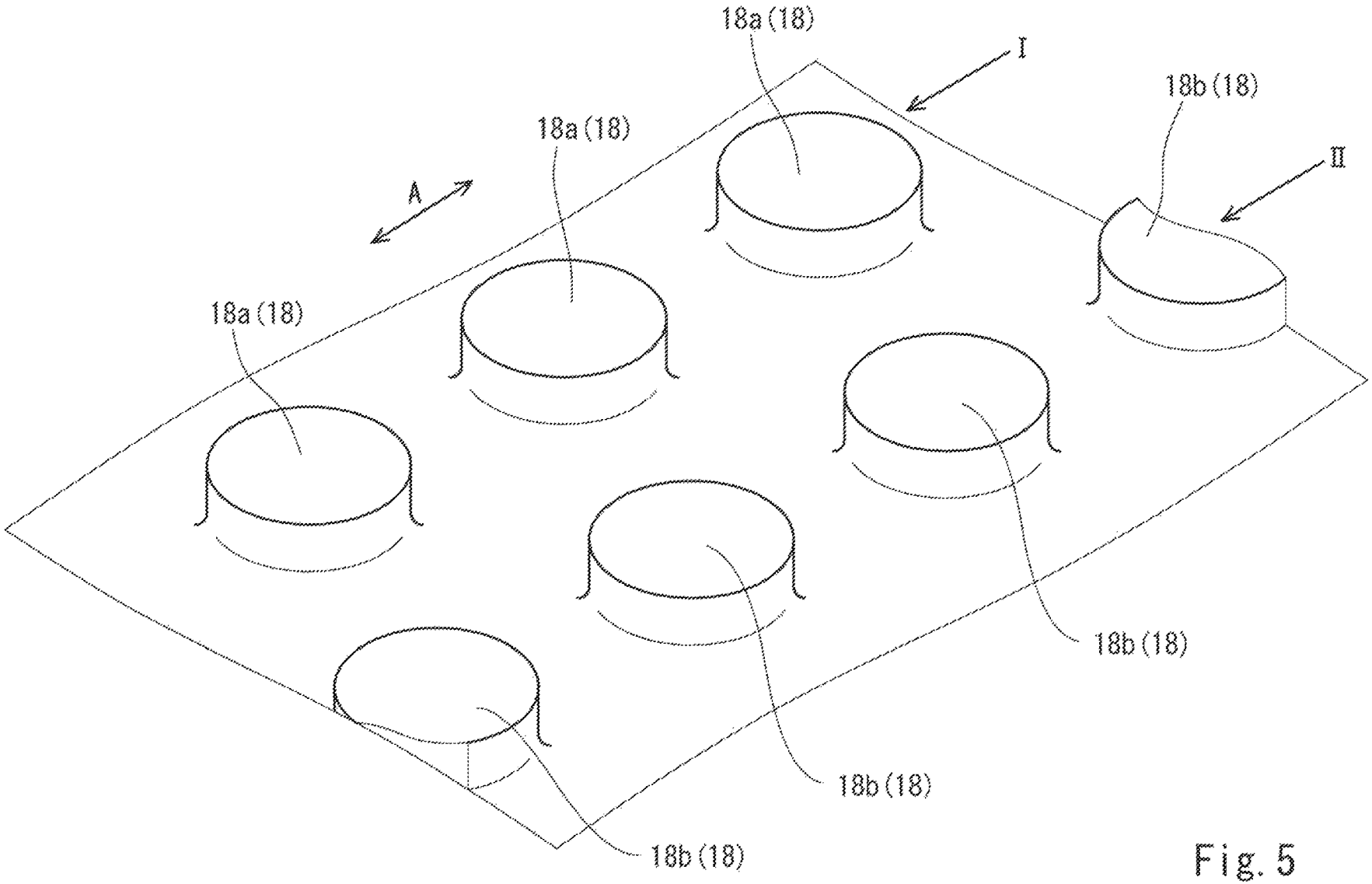
FIG. 5 is a partially enlarged perspective view of the surface of the golf ball in FIG. 1.

FIG. 5 is a partially enlarged perspective view of the surface of the golf ball 2 in FIG. 1. As shown in FIG. 5, the golf ball 2 has a large number of minute projections 18 on the surface thereof. Each minute projection 18 generally has a cylindrical shape. As is obvious from FIG. 4, the minute projections 18 are formed on the surfaces of the dimples 12 and also on the surface of the land 14. Each minute projection 18 stands outward in the radial direction of the golf ball 2. The minute projections 18 may be formed only on the surfaces of the dimples 12. The minute projections 18 may be formed only on the surface of the land 14.

The minute projections 18 reduce lift force and drag of the golf ball 2 during flight. Owing to the reduction of lift force, a large run can be achieved. Owing to the reduction of drag, a large carry can be achieved. The golf ball 2 has excellent flight performance upon a shot with a middle iron.

FIG. 5 shows a plurality of minute projections 18*a* belonging to a first row I, and a plurality of minute projections 18*b* belonging to a second row II. The direction indicated by an arrow A in FIG. 5 is the direction in which the rows extend. In each row, the minute projections 18 are aligned at equal pitches. In other words, the minute projections 18 are regularly aligned. The minute projections 18*a*, which belong to the first row I, and the minute projections 18*b*, which belong to the second row II, are arranged in a zigzag manner. At a part of the surface of the golf ball 2, the minute projections 18 may be irregularly aligned.

Figure 6:
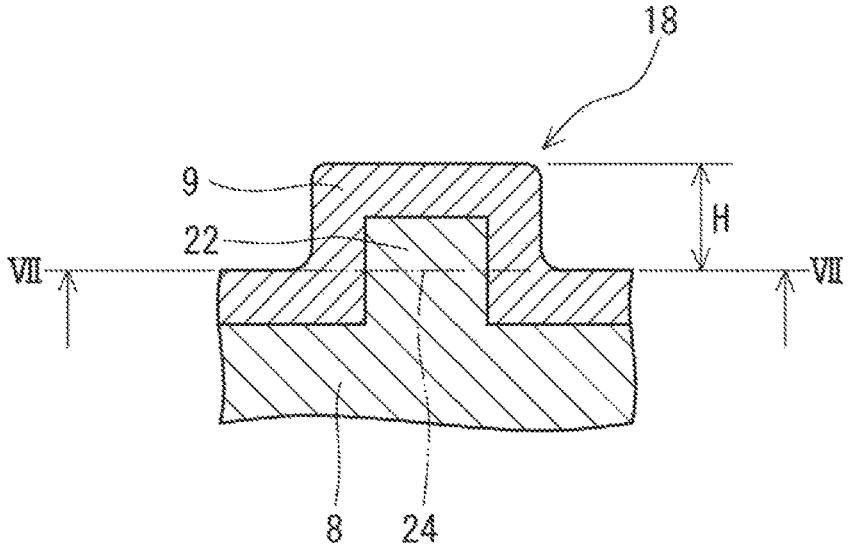
FIG. 6 is a partially enlarged cross-sectional view of the golf ball in FIG. 1.

FIG. 6 is a partially enlarged cross-sectional view of the golf ball 2 in FIG. 1. FIG. 6 shows the cover 8, which is a part of the main body 10, and the paint layer 9. FIG. 6 shows the minute projection 18. The cover 8 has a projection portion 22. The minute projection 18 is formed by the projection portion 22 and the paint layer 9. The projection portion 22 is covered with the paint layer 9. The projection portion 22 stands outward in the radial direction of the golf ball 2 (upward in FIG. 6). Thus, the minute projection 18 also stands outward in the radial direction of the golf ball 2. In other words, the minute projection 18 has a shape in which the surface shape of the main body 10 (cover 8) is reflected. In FIG. 6, reference sign 24 indicates the bottom surface of the minute projection 18.

Figure 7:
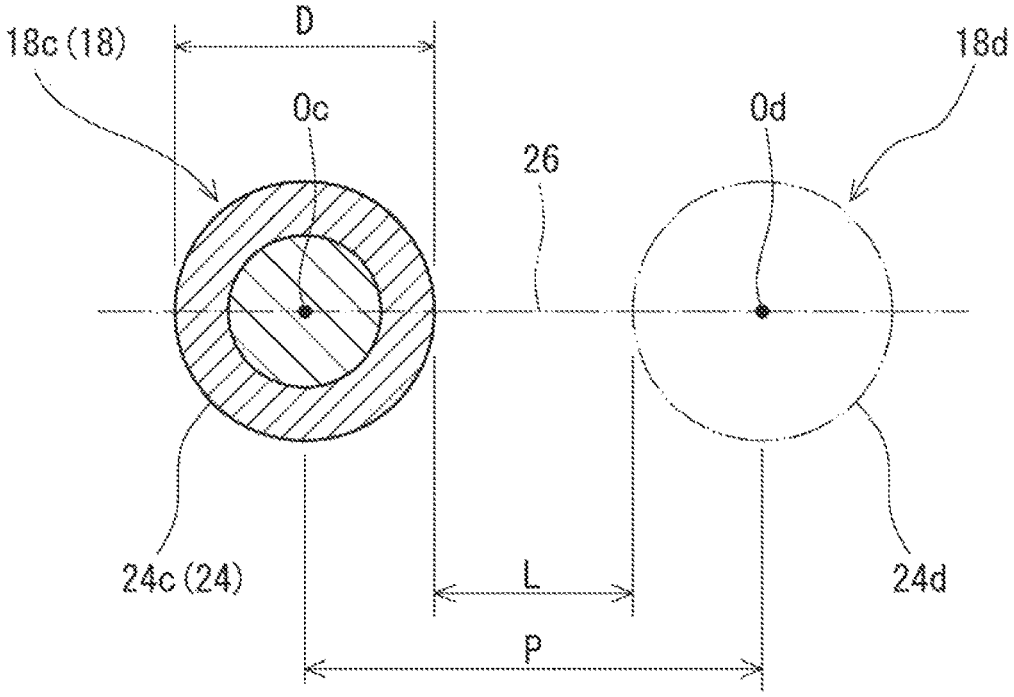
FIG. 7 is a cross-sectional view taken along the line VII-VII in FIG. 6.

FIG. 7 is a cross-sectional view taken along the line VII-VII in FIG. 6. FIG. 7 shows the bottom surface 24 of the minute projection 18. The bottom surface 24 includes the cover 8 and the paint layer 9. As described above, each minute projection 18 has a cylindrical shape. Therefore, the shape of the bottom surface 24 is a circle.

In FIG. 7, an arrow D indicates the diameter of the bottom surface 24 and indicates the diameter of the minute projection 18. An average diameter Dav is calculated by summing the diameters D of all the minute projections 18 and dividing the sum of the diameters D by the number of the minute projections 18. The average diameter Dav is preferably not less than 5 μm and not greater than 50 μm. The golf ball 2 in which the average diameter Dav is in the above range has excellent flight distance upon a shot with a middle iron. With the golf ball 2 in which the average diameter Dav is in the above range, the paint layer 9 is less likely to be peeled. From these viewpoints, the average diameter Dav is more preferably not less than 15 μm and particularly preferably not less than 20 μm. In light of flight distance, the average diameter Dav is more preferably not greater than 40 μm and particularly preferably not greater than 35 μm.

The area of each minute projection 18 is defined as the area of the bottom surface 24. The area Sp of the minute projection 18 shown in FIGS. 6 and 7 can be calculated by the following mathematical formula.

$$Sp=(D/2)^2*\pi$$

The ratio Pp of the sum of the areas Sp of all the minute projections 18 to the surface area of the phantom sphere 16 of the golf ball 2 is preferably not less than 7%. The golf ball 2 in which the ratio Pp is not less than 7% has excellent flight distance upon a shot with a middle iron. With the golf ball 2 in which the ratio Pp is not less than 7%, the paint layer 9 is less likely to be peeled. From these viewpoints, the ratio Pp is preferably not less than 15% and particularly preferably not less than 20%. In light of ease of production of a mold for the golf ball 2, the ratio Pp is preferably not greater than 50%, more preferably not greater than 40%, and particularly preferably not greater than 35%.

FIG. 7 shows a bottom surface 24*c* of a first minute projection 18*c* and also shows a bottom surface 24*d* of a second minute projection 18*d* by an alternate long and two short dashes line. The second minute projection 18*d* is adjacent to the first minute projection 18*c*. In FIG. 7, an alternate long and two short dashes line 26 represents a straight line passing through the center of gravity Oc of the bottom surface 24*c* of the first minute projection 18*c* and the center of gravity Od of the bottom surface 24*d* of the second minute projection 18*d*.

In FIG. 7, an arrow P indicates a pitch. The pitch P is the distance between the first minute projection 18*c* and the second minute projection 18*d* adjacent to the first minute projection 18*c*. The pitch P is the distance between the center of gravity Oc of the bottom surface 24*c* of the first minute projection 18*c* and the center of gravity Od of the bottom surface 24*d* of the second minute projection 18*d*. The "second minute projection 18*d* adjacent to the first minute projection 18*c*" is the minute projection 18*d* having a smallest distance L (described in detail later) to the first minute projection 18*c*, among the minute projections 18 present around the first minute projection 18*c*.

For each minute projection 18, one pitch P is determined. An average pitch Pav is calculated by summing the pitches P of all the minute projections 18 and dividing the sum of the pitches P by the number of the minute projections 18. The average pitch Pav is preferably not less than 10 μm. With the golf ball 2 in which the average pitch Pav is not less than 10 μm, the minute projections 18 do not excessively reduce lift force. With the golf ball 2, a large carry can be achieved. From this viewpoint, the average pitch Pav is more preferably not less than 20 μm and particularly preferably not less than 25 μm. The average pitch Pav is preferably not greater than 100 μm. With the golf ball 2 in which the average pitch Pav is not greater than 100 μm, the minute projections 18 reduce lift force and drag. With the golf ball 2, a large carry and a large run can be achieved. From this viewpoint, the average pitch Pav is more preferably not greater than 80 μm and particularly preferably not greater than 70 μm.

In FIG. 7, an arrow L indicates the distance between the first minute projection 18*c* and the second minute projection 18*d* adjacent to the first minute projection 18*c*. The distance L is a value obtained by subtracting the radius of the bottom surface 24*c* of the first minute projection 18*c* and the radius of the bottom surface 24*d* of the second minute projection 18*d* from the pitch P. For each minute projection 18, one distance L is determined. An average distance Lav is calculated by summing the distances L of all the minute projections 18 and dividing the sum of the distances L by the number of the minute projections 18. The average distance Lav is preferably not less than 5 μm and not greater than 50 μm. With the golf ball 2 in which the average distance Lav is not less than 5 μm, the minute projections 18 do not excessively reduce lift force. With the golf ball 2, a large carry can be achieved. From this viewpoint, the average distance Lav is more preferably not less than 10 μm and particularly preferably not less than 15 μm. With the golf ball 2 in which the average distance Lav is not greater than 50 μm, the minute projections 18 reduce lift force and drag. With the golf ball 2, a large carry and a large run can be achieved. From this viewpoint, the average distance Lav is more preferably not greater than 40 μm and particularly preferably not greater than 35 μm.

In FIG. 6, an arrow H indicates the height of the minute projection 18. The height H is measured along the radial direction of the golf ball 2. An average height Hav is calculated by summing the heights H of all the minute projections 18 and dividing the sum of the heights H by the number of the minute projections 18. The average height Hav is preferably not less than 0.5 μm and not greater than 50 μm. With the golf ball 2 in which the average height Hav is not less than 0.5 μm, the minute projections 18 reduce lift force and drag. With the golf ball 2, a large carry and a large run can be achieved. From this viewpoint, the average height Hav is more preferably not less than 2 μm and particularly preferably not less than 3 μm. With the golf ball 2 in which the average height Hav is not greater than 50 μm, the minute projections 18 do not excessively reduce lift force. With the golf ball 2, a large carry can be achieved. From this viewpoint, the average height Hav is more preferably not greater than 30 μm and particularly preferably not greater than 20 μm.

The total number of the minute projections 18 is preferably not less than 10 thousand and not greater than 10 million. With the golf ball 2 in which this total number is not less than 10 thousand, the minute projections 18 reduce lift force and drag. With the golf ball 2, a large carry and a large run can be achieved. From this viewpoint, this total number is more preferably not less than 20 thousand and particularly preferably not less than 50 thousand. With the golf ball 2 in which this total number is not greater than 10 million, the minute projections 18 do not excessively reduce lift force. With the golf ball 2, a large carry can be achieved. From this viewpoint, this total number is more preferably not greater than 7 million and particularly preferably not greater than 5 million.

In the golf ball 2, the average height Hav of the minute projections 18 and the average depth Dpav of the dimples 12 satisfy the following mathematical formula (1).

$$Hav/Dpav \leq 0.005 \quad (1)$$

In other words, the ratio (Hav/Dpav) of the average height Hav to the average depth Dpav is not less than 0.005. With the golf ball 2 in which the ratio (Hav/Dpav) is not less than 0.005, the minute projections 18 reduce lift force and drag. With the golf ball 2, a large carry and a large run can be achieved. From this viewpoint, the ratio (Hav/Dpav) is more preferably not less than 0.010 and particularly preferably not less than 0.015. The ratio (Hav/Dpav) is preferably not greater than 0.100. With the golf ball 2 in which the ratio (Hav/Dpav) is not greater than 0.100, the minute projections 18 do not excessively reduce lift force. With the golf ball 2, a large carry can be achieved. From this viewpoint, the ratio (Hav/Dpav) is more preferably not greater than 0.080 and particularly preferably not greater than 0.060.

As described above, each minute projection 18 includes the projection portion 22 of the main body 10 and the paint layer 9 (see FIG. 6). Therefore, even when the paint layer 9 is separated from the main body 10 due to the golf ball 2 being hit by a golf club or colliding against the ground, the shapes of the minute projections 18 are substantially maintained. Accordingly, the aerodynamic characteristics are substantially maintained. A special paint is not needed for forming the minute projections 18. The golf ball 2 can be easily produced.

The paint layer 9 preferably has a thickness of not less than 5 μm and not greater than 30 μm. The paint layer 9 having a thickness of not less than 5 μm contributes to the appearance of the golf ball 2. From this viewpoint, this thickness is more preferably not less than 7 μm and particularly preferably not less than 8 μm. In the golf ball 2 that has the paint layer 9 having a thickness of not greater than 30 μm, the shape of each projection portion 22 is reflected in the shape of the minute projection 18. From this viewpoint, this thickness is more preferably not greater than 25 μm and particularly preferably not greater than 20 μm.

The paint layer 9 may contain powder such as inorganic particles and a luminous material. The powder can contribute to the appearance of the golf ball 2. Furthermore, the powder increases the roughness of the surface of the golf ball 2. Therefore, the powder can also contribute to the aerodynamic characteristics of the golf ball 2. Preferably, the average particle diameter (median diameter D50) of the powder is not less than 1 μm and not greater than 15 μm. Typical inorganic particles are talc.

The surface of the golf ball 2 preferably has an arithmetic average height Sa of not less than 0.5 μm and not greater than 30 μm. With the golf ball 2 having an arithmetic average height Sa of not less than 0.5 μm, the minute projections 18 reduce lift force and drag. With the golf ball 2, a large carry and a large run can be achieved. From this viewpoint, the arithmetic average height Sa is more preferably not less than 1.0 μm and particularly preferably not less than 1.5 μm. With the golf ball 2 having an arithmetic average height Sa of not greater than 30 μm, the minute projections 18 do not excessively reduce lift force. With the golf ball 2, a large carry can be achieved. From this viewpoint, the arithmetic average height Sa is more preferably not greater than 20 μm and particularly preferably not greater than 15 μm.

The surface of the golf ball 2 preferably has a maximum height Sz of not less than 5 μm and not greater than 200 μm. With the golf ball 2 having a maximum height Sz of not less than 5 μm, the minute projections 18 reduce lift force and drag. With the golf ball 2, a large carry and a large run can be achieved. From this viewpoint, the maximum height Sz is more preferably not less than 10 μm and particularly preferably not less than 20 μm. With the golf ball 2 having a maximum height Sz of not greater than 200 μm, the minute projections 18 do not excessively reduce lift force. With the golf ball 2, a large carry can be achieved. From this viewpoint, the maximum height Sz is more preferably not greater than 150 μm and particularly preferably not greater than 100 μm.

The arithmetic average height Sa and the maximum height Sz are measured according to the standards of ISO-25178 with a laser microscope (for example, a non-contact type surface roughness/shape measuring instrument of Keyence Corporation). In the microscope, the surface of the golf ball 2 is scanned with a laser in an X direction and a Y direction. Through this scanning, unevenness data of the surface of the golf ball 2 is obtained. The arithmetic average height Sa and the maximum height Sz are calculated on the basis of a three-dimensional image obtained from the unevenness data. The measurement conditions are as follows.

Magnification: 1000
Measurement range X: 250 μm
Measurement range Y: 250 μm
Cutoff value: λc=0.25
Observation region: X=1024 pixels, Y=768 pixels
Total number of pixels: 786432 pixels The glossiness of the surface of the golf ball 2 is preferably not less than 0.1 and not greater than 20. The golf ball 2 in which the glossiness is in this range has excellent appearance. From this viewpoint, the glossiness is more preferably not less than 0.3 and not greater than 17, and particularly preferably not less than 0.5 and not greater than 15. The glossiness is measured according to the standards of "ASTM D523-60°".

Figure 8:
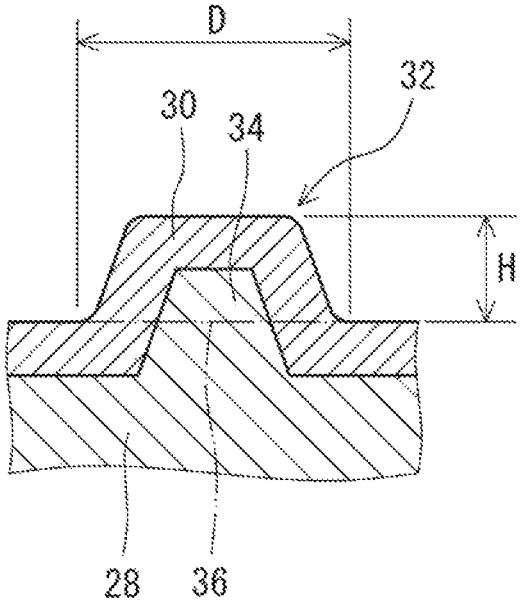
FIG. 8 is a cross-sectional view of a part of a golf ball according to another embodiment of the present invention.

FIG. 8 is a cross-sectional view of a part of a golf ball according to another embodiment of the present invention. FIG. 8 shows a cover 28 that is a part of a main body, and a paint layer 30. FIG. 8 also shows a minute projection 32. The cover 28 has projection portions 34. The minute projection 32 is formed by the projection portion 34 and the paint layer 30. Each projection portion 34 is covered with the paint layer 30. The projection portion 34 stands outward in the radial direction of the golf ball (the upward direction in FIG. 8), and thus the minute projection 32 also stands outward in the radial direction of the golf ball. In other words, the minute projection 32 has a shape in which the surface shape of the main body (the cover 28) is reflected. In FIG. 8, reference sign 36 indicates the bottom surface of the minute projection 32.

The projection portion 34 has a truncated cone shape. Therefore, the minute projection 32 also has a truncated cone shape. The specifications of this golf ball excluding the shape of the projection portion 34 and the shape of the minute projection 32 are the same as the specifications of the golf ball 2 shown in FIGS. 1 to 7.

With this golf ball as well, each minute projection 32 contributes to a flight distance upon a shot with a middle iron. With the golf ball as well, the paint layer 30 is less likely to be peeled from the main body (the cover 28).

The golf ball may have minute projections having a shape such as a cone shape, a prism shape, a truncated pyramid shape, a pyramid shape, a partial sphere shape, and the like.

EXAMPLES

Example 1

A rubber composition was obtained by kneading 100 parts by weight of a high-cis polybutadiene (trade name "BR-730", manufactured by JSR Corporation), 27.4 parts by weight of zinc diacrylate, 5 parts by weight of zinc oxide, an appropriate amount of barium sulfate, 0.5 parts by weight of diphenyl disulfide, and 0.9 parts by weight of dicumyl peroxide. This rubber composition was placed into a mold including upper and lower mold halves each having a hemispherical cavity, and heated at 160° C. for 20 minutes to obtain a core with a diameter of 38.20 mm. The amount of barium sulfate was adjusted such that a core having a predetermined weight was obtained.

A resin composition was obtained by kneading 26 parts by weight of an ionomer resin (trade name "Himilan AM7337", manufactured by Du Pont-MITSUI POLYCHEMICALS Co., Ltd.), 26 parts by weight of another ionomer resin (trade name "Himilan AM7329", manufactured by Du Pont-MITSUI POLYCHEMICALS Co., Ltd.), 48 parts by weight of a styrene block-containing thermoplastic elastomer (trade name "Rabalon T3221C", manufactured by Mitsubishi Chemical Corporation), 4 parts by weight of titanium dioxide (A220), and 0.2 parts by weight of a light stabilizer (trade name "JF-90", manufactured by Johoku Chemical Co., Ltd.) with a twin-screw kneading extruder. The core was covered with this resin composition by injection molding to form a mid layer. The thickness of the mid layer was 1.00 mm.

A resin composition was obtained by kneading 47 parts by weight of an ionomer resin (trade name "Himilan 1555", manufactured by Du Pont-MITSUI POLYCHEMICALS Co., Ltd.), 46 parts by weight of another ionomer resin (trade name "Himilan 1557", manufactured by Du Pont-MITSUI POLYCHEMICALS Co., Ltd.), 7 parts by weight of a styrene block-containing thermoplastic elastomer (the aforementioned "Rabalon T3221C"), 4 parts by weight of titanium dioxide (A220), and 0.2 parts by weight of a light stabilizer (the aforementioned "JF-90") with a twin-screw kneading extruder. The sphere consisting of the core and the mid layer was placed into a final mold having a large number of pimples and minute recesses on its cavity face. The mid layer was covered with the resin composition by injection molding to form a cover. The thickness of the cover was 1.25 mm. Dimples having a shape that is the inverted shape of the pimples were formed on the cover. Furthermore, minute projection portions having a shape that is the inverted shape of the minute recesses were formed on the cover.

A clear paint including a two-component curing type polyurethane as a base material was applied to this cover to obtain a golf ball of Example 1 with a diameter of about 42.7 mm and a weight of about 45.6 g. The golf ball has a large number of minute projections on the surface thereof. The specifications of these minute projections are shown in Table 2 below. The golf ball further has a large number of dimples on the surface thereof. The specifications of these dimples are shown in Table 1 below.

Examples 2 to 6 and 8 to 17 and Comparative Examples 1 and 2

Golf balls of Examples 2 to 6 and 8 to 17 and Comparative Examples 1 and 2 were obtained in the same manner as Example 1, except the final mold was changed and dimples and minute projections having specifications shown in Tables 2 to 6 below were formed. The specifications of the dimples are shown in Table 1 below.

Example 7

A golf ball of Example 7 was obtained in the same manner as Example 1, except a paint layer containing talc having an average particle diameter of 2 μm was provided. The amount of talc in the paint layer was 100 parts by weight per 100 parts by weight of the resin component.

Comparative Examples 3 and 4

A golf ball of Comparative Example 3 was obtained in the same manner as Example 1, except the final mold was changed and dimples having specifications shown in Table 6 below were formed. A golf ball of Comparative Example 4 was obtained in the same manner as Example 1, except the final mold was changed, dimples having specifications shown in Table 6 below were formed, and a paint layer containing talc was provided. The specifications of the dimples are shown in Table 1 below. The golf balls according to Comparative Examples 3 and 4 do not have any minute projections.

Flight Test

An iron club #7 (trade name "XXIO 10", manufactured by Sumitomo Rubber Industries, Ltd., shaft hardness: R) was attached to a swing machine manufactured by Golf Laboratories, Inc. A golf ball was hit under a condition of a head speed of 33 m/sec, and the carry and the run were measured. During the test, the weather was almost windless. The average value of data obtained by 20 measurements is shown in Tables 2 to 6 below.

TABLE 1

Specifications of Dimples

| | Type | Number | Dm (mm) | Dp (mm) | Dp2 (mm) | CR (mm) | Volume ($mm^3$) |
|---|---|---|---|---|---|---|---|
| (a)-1 | A | 30 | 4.40 | 0.125 | 0.239 | 19.4 | 0.951 |
| | B | 140 | 4.30 | 0.125 | 0.234 | 18.6 | 0.909 |
| | C | 90 | 4.20 | 0.125 | 0.229 | 17.7 | 0.867 |
| | D | 40 | 3.95 | 0.120 | 0.212 | 16.3 | 0.736 |
| | E | 40 | 3.50 | 0.115 | 0.187 | 13.4 | 0.554 |
| (a)-2 | A | 30 | 4.40 | 0.140 | 0.254 | 17.4 | 1.066 |
| | B | 140 | 4.30 | 0.140 | 0.249 | 16.6 | 1.018 |
| | C | 90 | 4.20 | 0.140 | 0.244 | 15.8 | 0.971 |
| | D | 40 | 3.95 | 0.135 | 0.227 | 14.5 | 0.828 |
| | E | 40 | 3.50 | 0.130 | 0.202 | 11.8 | 0.627 |
| (a)-3 | A | 30 | 4.40 | 0.155 | 0.269 | 15.7 | 1.180 |
| | B | 140 | 4.30 | 0.155 | 0.264 | 15.0 | 1.127 |
| | C | 90 | 4.20 | 0.155 | 0.259 | 14.3 | 1.076 |
| | D | 40 | 3.95 | 0.150 | 0.242 | 13.1 | 0.921 |
| | E | 40 | 3.50 | 0.145 | 0.217 | 10.6 | 0.699 |
| (b) | A | 168 | 4.50 | 0.156 | 0.275 | 16.3 | 1.243 |
| | B | 168 | 3.40 | 0.146 | 0.214 | 10.0 | 0.664 |

DP2: Depth from spherical surface

CR: Curvature radius

TABLE 2

Results of Evaluation

| | Compa. Example 1 | Example 2 | Example 1 | Example 3 |
|---|---|---|---|---|
| Dimple | (a)-2 | (a)-2 | (a)-2 | (a)-2 |
| Front view | FIG. 2 | FIG. 2 | FIG. 2 | FIG. 2 |
| Plan view | FIG. 3 | FIG. 3 | FIG. 3 | FIG. 3 |
| Total volume ($mm^3$) | 320.1 | 320.1 | 320.1 | 320.1 |
| Dpav (μm) | 138 | 138 | 138 | 138 |
| Dav (μm) | 25 | 25 | 25 | 25 |
| Pav (μm) | 50 | 50 | 50 | 50 |
| Pp (%) | 22.7% | 22.7% | 22.7% | 22.7% |
| Hav (μm) | 0.4 | 1.5 | 5 | 10 |
| Hav/Dpav | 0.003 | 0.011 | 0.036 | 0.072 |
| Talc | Absent | Absent | Absent | Absent |
| Sa (μm) | 0.2 | 0.5 | 2.0 | 5.0 |
| Sz (μm) | 2 | 5 | 20 | 50 |
| Carry (m) | 126.2 | 126.7 | 127.0 | 126.7 |
| Run (m) | 8.2 | 8.4 | 9.5 | 9.3 |
| Total (m) | 134.4 | 135.1 | 136.5 | 136.0 |

TABLE 3

Results of Evaluation

| | Example 4 | Example 5 | Example 6 | Compa. Example 2 |
|---|---|---|---|---|
| Dimple | (a)-2 | (a)-2 | (a)-2 | (a)-2 |
| Front view | FIG. 2 | FIG. 2 | FIG. 2 | FIG. 2 |
| Plan view | FIG. 3 | FIG. 3 | FIG. 3 | FIG. 3 |
| Total volume ($mm^3$) | 320.1 | 320.1 | 320.1 | 320.1 |
| Dpav (μm) | 138 | 138 | 138 | 138 |
| Dav (μm) | 25 | 25 | 25 | 25 |
| Pav (μm) | 50 | 50 | 50 | 50 |
| Pp (%) | 22.7% | 22.7% | 22.7% | 22.7% |
| Hav (μm) | 15 | 25 | 40 | 50 |
| Hav/Dpav | 0.109 | 0.181 | 0.289 | 0.362 |
| Talc | Absent | Absent | Absent | Absent |
| Sa (μm) | 8.0 | 15.0 | 30.0 | 40.0 |
| Sz (μm) | 80 | 120 | 240 | 300 |
| Carry (m) | 126.6 | 126.4 | 126.5 | 126.3 |
| Run (m) | 8.9 | 8.9 | 8.5 | 8.2 |
| Total (m) | 135.5 | 135.3 | 135.0 | 134.5 |

TABLE 4

Results of Evaluation

Figure 9:
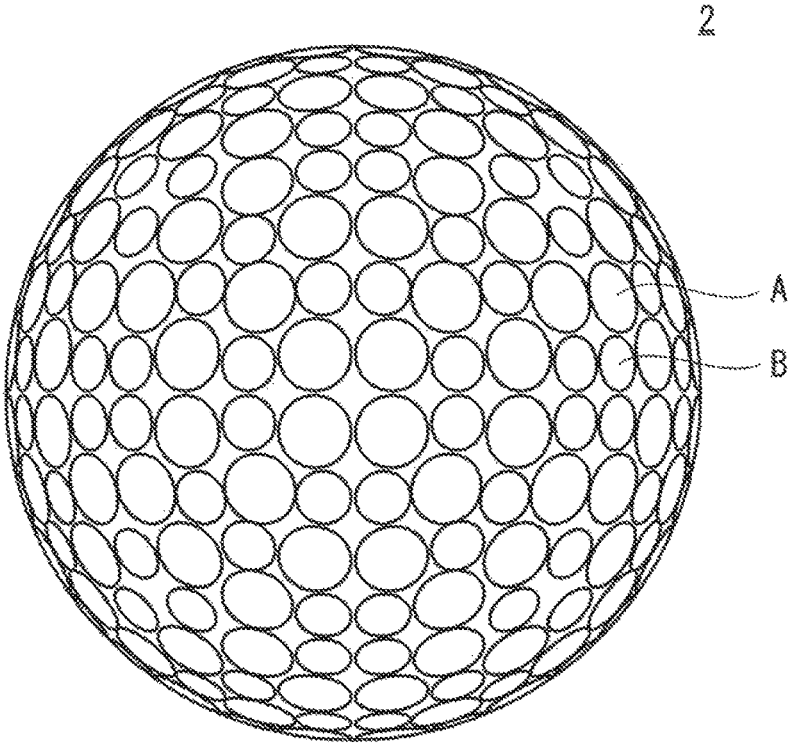
FIG. 9 is a front view of a golf ball according to Example 7 of the present invention.
Figure 10:
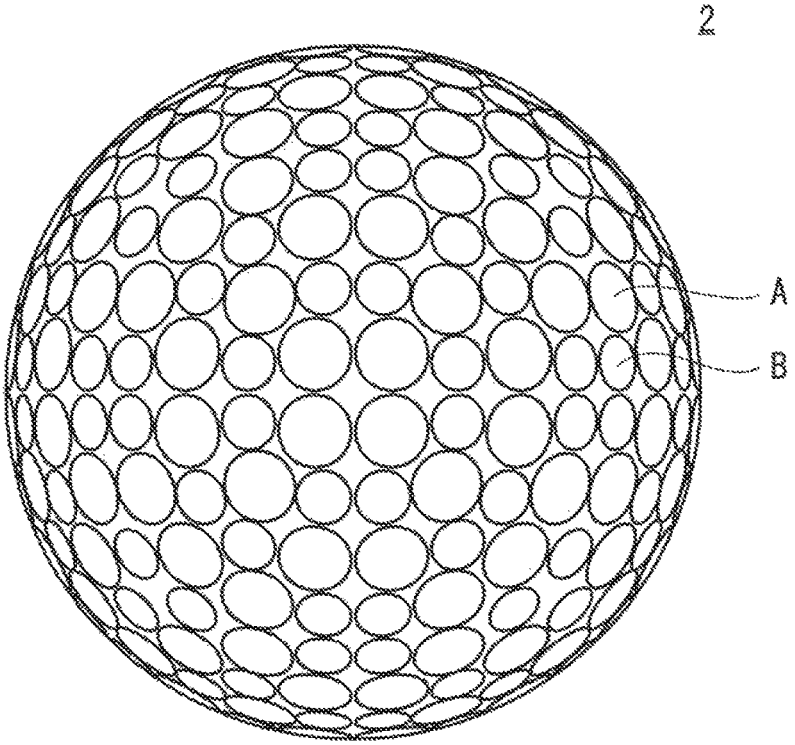
FIG. 10 is a plan view of the golf ball in FIG. 9.

| | Example 7 | Example 8 | Example 9 | Example 10 |
|---|---|---|---|---|
| Dimple | (a)-2 | (a)-1 | (a)-3 | (b) |
| Front view | FIG. 2 | FIG. 2 | FIG. 2 | FIG. 9 |
| Plan view | FIG. 3 | FIG. 3 | FIG. 3 | FIG. 10 |
| Total volume ($mm^3$) | 320.1 | 285.4 | 354.9 | 320.4 |
| Dpav (μm) | 138 | 123 | 153 | 151 |
| Dav (μm) | 25 | 25 | 25 | 25 |
| Pav (μm) | 50 | 50 | 50 | 50 |
| Pp (%) | 22.7% | 22.7% | 22.7% | 22.7% |
| Hav (μm) | 5 | 5 | 5 | 5 |
| Hav/Dpav | 0.036 | 0.041 | 0.033 | 0.033 |
| Talc | Present | Absent | Absent | Absent |
| Sa (μm) | 2.5 | 2.0 | 2.0 | 2.0 |
| Sz (μm) | 25 | 20 | 20 | 20 |
| Carry (m) | 127.6 | 128.0 | 127.5 | 126.7 |
| Run (m) | 10.1 | 9.0 | 10.5 | 9.2 |
| Total (m) | 137.7 | 137.0 | 138.0 | 135.9 |

TABLE 5

Results of Evaluation

| | Example 11 | Example 12 | Example 13 | Example 14 | Example 15 |
|---|---|---|---|---|---|
| Dimple | (a)-2 | (a)-2 | (a)-2 | (a)-2 | (a)-2 |
| Front view | FIG. 2 | FIG. 2 | FIG. 2 | FIG. 2 | FIG. 2 |
| Plan view | FIG. 3 | FIG. 3 | FIG. 3 | FIG. 3 | FIG. 3 |
| Total volume ($mm^3$) | 320.1 | 320.1 | 320.1 | 320.1 | 320.1 |
| Dpav (μm) | 138 | 138 | 138 | 138 | 138 |
| Dav (μm) | 15 | 5 | 40 | 25 | 50 |
| Pav (μm) | 30 | 20 | 80 | 75 | 100 |
| Pp (%) | 22.7% | 5.7% | 22.7% | 10.1% | 22.7% |
| Hav (μm) | 5 | 5 | 5 | 5 | 5 |
| Hav/Dpav | 0.036 | 0.036 | 0.036 | 0.036 | 0.036 |
| Talc | Absent | Absent | Absent | Absent | Absent |
| Sa (μm) | 2.0 | 2.0 | 2.0 | 2.0 | 2.0 |
| Sz (μm) | 20 | 20 | 20 | 20 | 20 |
| Carry (m) | 127.2 | 126.6 | 126.8 | 126.5 | 126.2 |
| Run (m) | 9.7 | 9.1 | 9.2 | 8.7 | 8.7 |
| Total (m) | 136.9 | 135.7 | 136.0 | 135.2 | 134.9 |

TABLE 6

| Results of Evaluation | | | | |
|---|---|---|---|---|
| | Example 16 | Example 17 | Compa. Example 3 | Compa. Example 4 |
| Dimple | (a)-2 | (a)-2 | (a)-2 | (a)-2 |
| Front view | FIG. 2 | FIG. 2 | FIG. 2 | FIG. 2 |
| Plan view | FIG. 3 | FIG. 3 | FIG. 3 | FIG. 3 |
| Total volume ($mm^3$) | 320.1 | 320.1 | 320.1 | 320.1 |
| Dpav (μm) | 138 | 138 | 138 | 138 |
| Dav (μm) | 25 | 60 | — | — |
| Pav (μm) | 95 | 120 | — | — |
| Pp (%) | 6.3% | 22.7% | 0 | 0 |
| Hav (μm) | 5 | 5 | — | — |
| Hav/Dpav | 0.036 | 0.036 | — | — |
| Talc | Absent | Absent | Absent | Present |
| Sa (μm) | 2.0 | 2.0 | 0.1 | 1.0 |
| Sz (μm) | 20 | 20 | 0.5 | 5 |
| Carry (m) | 126.5 | 126.1 | 126.0 | 126.3 |
| Run (m) | 8.9 | 8.3 | 8.0 | 8.3 |
| Total (m) | 135.4 | 134.8 | 134.0 | 134.6 |

As shown in Tables 2 to 6, the golf ball of each Example has excellent flight performance upon a shot with a middle iron. From the evaluation results, advantages of the present invention are clear.

The aforementioned minute projections are applicable to golf balls having various structures such as a one-piece golf ball, a two-piece golf ball, a four-piece golf ball, a five-piece golf ball, a six-piece golf ball, a thread-wound golf ball, and the like in addition to a three-piece golf ball. The above descriptions are merely illustrative examples, and various modifications can be made without departing from the principles of the present invention.

What is claimed is:

1. A golf ball comprising a main body and a paint layer positioned outside the main body, wherein the golf ball has, on a surface thereof, a plurality of minute projections, the surface of the golf ball has an arithmetic average height Sa of not less than 0.5 μm and not greater than 30 μm, and an average value Hav of heights H of the minute projections is not less than 2 μm and not greater than 50 μm, wherein the arithmetic average height Sa is based on a three-dimensional image obtained from a laser microscope scanning of the golf ball surface to generate unevenness data and corresponds to the average height of the surface of the golf ball as measured according to the standards of ISO-25178.

2. The golf ball according to claim 1, wherein a ratio Pp of a sum of areas of all the minute projections to a surface area of a phantom sphere of the golf ball is not less than 7%.

3. The golf ball according to claim 1, wherein an average value Dav of diameters D of the minute projections is not less than 5 μm and not greater than 50 μm.

4. The golf ball according to claim 1, wherein an average value Pav of pitches P each between a minute projection and another minute projection adjacent to this minute projection is not greater than 100 μm.

5. The golf ball according to claim 1, wherein the surface of the golf ball has a maximum height Sz of not less than 5 μm and not greater than 200 μm.

6. The golf ball according to claim 1, further comprising a plurality of dimples on the surface thereof, wherein the average value Hav of the heights H of the minute projections and an average value Dpav of depths Dp of the dimples satisfy the following mathematical formula (1):

$$Hav/Dpav>0.005 \quad (1).$$

7. The golf ball according to claim 1, wherein the paint layer has a thickness of not less than 5 μm and not greater than 30 μm.

8. The golf ball according to claim 1, wherein the paint layer contains powder having an average particle diameter of not less than 1 μm and not greater than 15 μm.

9. The golf ball according to claim 5, wherein the maximum height Sz is based on a three-dimensional image obtained from a laser microscope scanning of the golf ball surface to generate unevenness data and corresponds to the average height of the surface of the golf ball as measured according to the standards of ISO-25178.

* * * * *